US010569286B2

(12) United States Patent
Anderson et al.

(10) Patent No.: US 10,569,286 B2
(45) Date of Patent: Feb. 25, 2020

(54) SHAPED CARTRIDGE DISPENSING SYSTEMS

(71) Applicant: Ecolab USA Inc., St. Paul, MN (US)

(72) Inventors: Daniel D. Anderson, Eagan, MN (US); Amber C. Spolarich, Greensboro, NC (US); Morgan G. Wanless, Greensboro, NC (US); Jeremy B. Finison, Pine Hall, NC (US)

(73) Assignee: Ecolab USA Inc., St. Paul, MN (US)

( * ) Notice: Subject to any disclaimer, the term of this patent is extended or adjusted under 35 U.S.C. 154(b) by 137 days.

(21) Appl. No.: 15/589,663

(22) Filed: May 8, 2017

(65) Prior Publication Data

US 2018/0318862 A1 Nov. 8, 2018

(51) Int. Cl.
*B65D 83/04* (2006.01)
*B05B 11/00* (2006.01)
(Continued)

(52) U.S. Cl.
CPC ..... *B05B 11/0097* (2013.01); *B05B 11/0054* (2013.01); *B65B 1/04* (2013.01); *B65B 3/04* (2013.01)

(58) Field of Classification Search
CPC ..... B05B 11/0097; B05B 11/0054; B65B 83/0445; B65B 83/0409; B65B 83/06; B65B 1/04; B65B 3/04; C11D 17/041
See application file for complete search history.

(56) References Cited

U.S. PATENT DOCUMENTS 2,499,158 A 2/1950 Perry
2,620,061 A 12/1952 Uxa
(Continued)

FOREIGN PATENT DOCUMENTS

AU 467743 B1 10/1972
AU 7850481 8/1982
(Continued)

OTHER PUBLICATIONS

"SolidSense," Kay Chemical Company, 2014 (Applicant points out, in accordance with MPEP 609.04(a), that the year of publication, 2014, is sufficiently earlier than the effective U.S. filing date, Mar. 20, 2015, so that the particular month of publication is not in issue.) 2 pp.
(Continued)

*Primary Examiner* — Nicolas A Arnett
(74) *Attorney, Agent, or Firm* — Shumaker & Sieffert, P.A.

(57) ABSTRACT

Dispensing systems utilize shaped cartridges to dispense one or more different types of chemical product concentrates. The chemical product concentrates may include, for example, tablets, capsules, encapsulated pellets or loose powders, or any other unit dose form factor. The chemical product concentrates may also include loose pellets or loose powders, or any other form of chemical product concentrate. The chemical product concentrates are dispensed from a plurality of shaped dispensing cartridges having different geometrically shaped cross-sections. Each cross-sectional shape may correspond to a different type of chemical product concentrate. Dispensing units include one or more shaped receptacles, each having a different geometrically shaped cross-section sized to receive a geometrically compatible one of the shaped dispensing cartridges. The dispensing units may further include shaped dispensing fitments sized to receive a geometrically compatible neck of a product container.

19 Claims, 9 Drawing Sheets

(51) Int. Cl.
*B65B 1/04* (2006.01)
*B65B 3/04* (2006.01)

(56) References Cited

U.S. PATENT DOCUMENTS 2,816,510 A 12/1957 Percival
2,853,206 A 9/1958 Uxa
3,231,139 A 1/1966 Bouet
3,410,455 A 11/1968 Haas
3,422,991 A 1/1969 MacDougall et al.
3,565,284 A 2/1971 Hinterreiter
3,620,413 A 11/1971 Borsum
3,628,893 A 12/1971 Carpigiani
3,680,736 A 8/1972 Viessman
3,764,238 A 10/1973 Carpigiani
3,797,701 A 3/1974 Alloco et al.
3,844,445 A 10/1974 Haas
3,845,882 A 11/1974 Haas
3,942,683 A 3/1976 Haas
3,968,902 A 7/1976 Bachmann
4,000,831 A 1/1977 House
4,171,753 A 10/1979 Vreede
4,193,745 A 3/1980 Hamilton et al.
4,295,580 A 10/1981 Amberg
4,311,251 A 1/1982 Sternberg
4,322,018 A 3/1982 Rutter
4,378,895 A 4/1983 Woinarski
4,429,812 A 2/1984 Steiner et al.
4,589,575 A 5/1986 Rigberg et al.
4,601,645 A 7/1986 Schmitkons
4,894,874 A 1/1990 Wilson
4,911,331 A 3/1990 Sedam
4,948,014 A 8/1990 Rutter et al.
4,974,753 A 12/1990 Tucker et al.
5,025,516 A 6/1991 Wilson
5,071,033 A 12/1991 Siwek
5,099,232 A 3/1992 Howes
5,100,030 A 3/1992 Roggenburg, Jr. et al.
5,178,298 A 1/1993 Allina
5,209,377 A 5/1993 Steiner et al.
5,240,147 A 8/1993 Frazier et al.
5,262,132 A 11/1993 Bricker et al.
5,465,877 A 11/1995 Bell et al.
5,501,372 A 3/1996 Daansen
5,531,363 A 7/1996 Gross et al.
5,549,273 A 8/1996 Aharon
5,586,573 A 12/1996 Nortier
5,836,482 A 11/1998 Ophardt et al.
5,875,921 A 3/1999 Osgar et al.
5,906,299 A 5/1999 Hagleitner
5,931,302 A 8/1999 Isaacs et al.
5,944,227 A 8/1999 Schroeder et al.
5,992,698 A 11/1999 Copeland et al.
6,082,407 A 7/2000 Paterson et al.
6,125,482 A 10/2000 Foster
6,127,671 A 10/2000 Parsons et al.
6,131,773 A 10/2000 Wade et al.
6,209,184 B1 4/2001 Copeland et al.
6,230,931 B1 5/2001 Mandle et al.
6,273,296 B1 8/2001 Brown
6,294,786 B1 9/2001 Marcichow et al.
6,401,970 B1 6/2002 Harris et al.
6,412,666 B1 7/2002 Hogan et al.
6,420,737 B1 7/2002 Fan
6,435,372 B1 8/2002 Blacker et al.
6,607,103 B2 8/2003 Gerenraich et al.
6,644,339 B2 11/2003 Gorges et al.
6,758,372 B2 7/2004 Studer et al.
6,877,642 B1 4/2005 Maddox et al.
6,929,154 B2 8/2005 Grey et al.
7,028,861 B2 4/2006 Sayers et al.
7,104,519 B2 9/2006 O'Maley et al.
7,416,357 B2 8/2008 Thiebaut
7,537,024 B2 * 5/2009 Adams ..... C01B 3/065 137/614.03
7,575,022 B2 8/2009 Higgins
7,708,023 B2 5/2010 Thomas et al.
7,967,160 B2 6/2011 Rault et al.
8,020,733 B2 9/2011 Snodgrass
8,071,933 B2 12/2011 Ophardt et al.
8,256,642 B2 9/2012 McNamara et al.
8,336,740 B1 12/2012 Daansen
8,397,958 B2 3/2013 Smith et al.
8,875,749 B2 * 11/2014 Nufer ..... G01G 13/003 141/1
8,915,634 B2 12/2014 Hsu et al.
9,126,815 B2 9/2015 Cooper et al.
9,295,350 B2 3/2016 Smith et al.
2001/0020623 A1 9/2001 McDonough et al.
2003/0000961 A1 1/2003 Klima et al.
2003/0024941 A1 2/2003 Coleman et al.
2004/0020723 A1 2/2004 Schuman et al.
2005/0067476 A1 3/2005 Hengami
2005/0087552 A1 4/2005 Ciavarella et al.
2005/0139612 A1 6/2005 Matthews et al.
2006/0249536 A1 11/2006 Hartman et al.
2007/0068599 A1 * 3/2007 Iaconis ..... H01M 8/04201 141/351
2007/0272709 A9 11/2007 Ciavarella et al.
2008/0054018 A1 3/2008 Stechschulte et al.
2008/0072993 A1 * 3/2008 Luchinger ..... B65B 3/30 141/18
2008/0277421 A1 11/2008 Zlatic et al.
2009/0127282 A1 5/2009 Reynolds et al.
2009/0212078 A1 8/2009 Gaus
2010/0163580 A1 7/2010 Ophardt et al.
2010/0294703 A1 11/2010 Hall
2011/0101029 A1 5/2011 Lewis, II et al.
2011/0108578 A1 5/2011 Wegelin et al.
2011/0132493 A1 * 6/2011 Kozu ..... H01M 8/04201 141/383
2011/0139808 A1 6/2011 Gatski
2011/0168712 A1 7/2011 Bailey et al.
2011/0168738 A1 7/2011 Nevarez et al.
2011/0210139 A1 9/2011 Limback et al.
2012/0048891 A1 3/2012 Hagleitner
2013/0032613 A1 2/2013 Ciavarella et al.
2013/0036775 A1 2/2013 Brueckner et al.
2013/0081363 A1 * 4/2013 Kunik ..... B65D 90/00 53/473
2013/0292403 A1 11/2013 Cote et al.
2015/0014369 A1 1/2015 Hatton et al.
2015/0265106 A1 9/2015 Rospierski
2016/0038889 A1 2/2016 Freudenberg et al.
2017/0021312 A1 1/2017 Schwartz et al.

FOREIGN PATENT DOCUMENTS

AU 6966081 9/1987
AU 7896587 3/1988
CA 1067869 12/1979
CN 201023841 Y 2/2008
CN 201647398 U 11/2010
CN 201686178 U 12/2010
CN 102582964 7/2012
CN 202743726 U 2/2013
DE 2828062 A1 10/1980
DE 3016834 A1 11/1981
DE 3143953 A1 5/1983
DE 3217739 A1 12/1983
DE 3417751 A1 11/1985
DE 10325233 A1 12/2004
DE 102008059674 A1 5/2010
EP 0166099 A2 1/1986
EP 0281366 A2 9/1988
EP 1995368 A2 11/2008
FR 1224690 6/1960
FR 2335411 A1 7/1977
FR 2449616 A1 9/1980
FR 2851989 A1 9/2004
FR 2871145 A1 12/2005
FR 1913005 A1 8/2008
GB 448886 6/1936

(56) References Cited

FOREIGN PATENT DOCUMENTS

| | | | |
|---|---|---|---|
| GB | 714966 | | 9/1954 |
| GB | 871685 | | 6/1961 |
| GB | 1067476 | | 5/1967 |
| GB | 1086892 | | 10/1967 |
| GB | 1505274 | | 3/1978 |
| GB | 2122171 | | 5/1982 |
| GB | 2361471 | | 10/2001 |
| GB | 2494029 | | 2/2013 |
| IT | MI931924 | | 3/1995 |
| IT | 1272590 | B | 6/1997 |
| JP | 9226855 | | 2/1997 |
| JP | 2001158482 | | 6/2001 |
| JP | 2008133001 | | 6/2008 |
| JP | 4538531 | B1 | 9/2010 |
| JP | 2010235194 | | 10/2010 |
| JP | 2013141987 | | 7/2013 |
| NL | 7901221 | | 8/1980 |
| NL | 8204585 | | 6/1984 |
| WO | 8200024 | A1 | 1/1982 |
| WO | 200144077 | A1 | 6/2001 |
| WO | 0185571 | A1 | 11/2001 |
| WO | 0230789 | A1 | 4/2002 |
| WO | 2007039779 | A1 | 4/2007 |
| WO | 2008114177 | A1 | 9/2008 |
| WO | 2009108154 | A1 | 9/2009 |

OTHER PUBLICATIONS

"Introducing the KAY SolidSense Cleaning System," Kay Chemical Company, 2008 (Applicant points out, in accordance with MPEP 609.04(a), that the year of publication, 2008, is sufficiently earlier than the effective U.S. filing date, Mar. 20, 2015, so that the particular month of publication is not in issue.) 3 pp.

Sloan Valve Company, "Battery Hand washing faucet—EBF-550," Sloan Optima Systems, Optima Plus EBF-550 S.S.—Rev 3a, Feb. 2011, 2 pp.

iTouchless Housewares & Products, Inc., EZ Faucet Infrared Sensor Faucet Adaptor, retrieved from http://www.itouchless.net/share/cgi-bin/site.cgi?site_id=itouchlessnet&page_id=ezfaucet, on Mar. 15, 2017, 3 pp.

Sloan Valve Company, "Electronic Hand Washing Faucet," Optima ETF-80, Apr. 2014, 2 pp.

Sloan Valve Company, "Electronic Hand Washing Faucet," Optima ETF-600 S.S.—Rev. 2a, Jul. 2012, 2 pp.

Sloan Valve Company, "Electronic Hand Washing Faucet," Optima ETF-610 S.S.—Rev lc, May 2011, 2 pp.

Sloan Valve Company, "Electronic Hand Washing Faucet," Optima ETF-660 S.S.—Rev 1b, May 2011, 2 pp.

Sloan Valve Company, "Electronic Hand Washing Faucet," Optima ETF-800 S.S—Rev. 0d, Mar. 2012, 2 pp.

Sloan Valve Company, "Electronic Hand Washing Faucet," Optima ETF-880 S.S.—Rev. 0c, May 2011, 2 pp.

Sloan Valve Company, "Electronic Gooseneck Hand Washing Faucet," Optima ETF-500 S.S.—Rev. 2b, May 2011, 2 pp.

Sloan Valve Company, "Electronic Gooseneck Hand Washing Faucet," Optima ETF-700 S.S.—Rev. 2, Nov. 2008, 2 pp.

Sloan Valve Company, "Electronic Gooseneck Hand Washing Faucet," Optima ETF-770 S.S.—Rev 1e, May 2011, 2 pp.

U.S. Appl. No. 15/654,222, filed Jul. 19, 2017, by Rospierski et al.

Prosecution History from U.S. Appl. No. 14/664,534, dated Mar. 3, 2016 through Apr. 12, 2017, 34 pp.

Office Action from U.S. Appl. No. 15/654,222, dated Apr. 19, 2018, 9 pp.

Response to Office Action dated Apr. 19, 2018, from U.S. Appl. No. 15/654,222, filed Jul. 18, 2018, 8 pp.

International Search Report and Written Opinion of counetrpart International Application No. PCT/US2018/030464, dated Jul. 13, 2008, 15 pp.

Notice of Allowance from U.S. Appl. No. 15/654,222, dated Nov. 26, 2018, 7 pp.

International Preliminary Report on Patentability from International Application No. PCT/US2018/030464, dated Nov. 21, 2019, 8 pp.

* cited by examiner

SHAPED CARTRIDGE DISPENSING SYSTEMS

TECHNICAL FIELD

The disclosure relates generally to chemical product dispensing.

BACKGROUND

Chemical products, such as detergents, disinfectants, sanitizers, and other chemical cleaning products, are widely used in many industries. The products may be packaged in a concentrated product form in which some or substantially all the water has been removed. These chemical product concentrates may permit more efficient transport and storage as compared to their ready-to-use counterparts. Such concentrated chemical products may include solid forms such as blocks, tablets, pellets, and loose powders, encapsulated or packeted gels or foams, etc. Chemical product concentrates may be formulated in a desired dosage. For example, when a unit dose tablet is dissolved in a predetermined volume of water or other diluent, a use solution having a desired concentration of the chemical product is achieved. Similarly, a unit dose (e.g., volume or weight) of a pelleted, powdered, gel or other concentrate may be combined with a predetermined volume of water to create a use solution having a desired concentration of the chemical product. Unit doses of these concentrates may be packaged as encapsulated or packeted pellets, powders, gels, etc. Such concentrated products may be used for a variety of products and applications including detergents, disinfectants, sanitizers, glass cleaners, rinse aids, fabric softeners, bleaches, optical brightening chemicals, starching chemicals, pool chemicals, and cleaners, disinfectants and sanitizers in general.

SUMMARY

In general, the disclosure is directed to systems for dispensing of chemical product concentrates. The chemical product concentrates may include, for example, tablets, capsules, or other unit dose form factor. The chemical product concentrates may also include loose pellets or loose powders, encapsulated or packeted concentrates, or any other form of chemical product concentrate.

In one example, the disclosure is directed to a dispensing system comprising a plurality of shaped dispensing cartridges, each shaped dispensing cartridge having one of a plurality of different geometrically shaped cross-sections, and each having a longitudinal cavity sized to receive a plurality of unit dose chemical product concentrates, wherein each of the plurality of geometrically shaped cross-sections corresponds to a different type of unit dose chemical product concentrate; and a dispensing unit configured to dispense one or more unit dose chemical product concentrates from one or more of the shaped dispensing cartridges, the dispensing unit including one or more shaped receptacles, each shaped receptacle having a different geometrically shaped cross-section sized to receive one of the shaped dispensing cartridges having a geometrically compatible shaped cross-section, and to reject the shaped dispensing cartridges having geometrically incompatible shaped cross-sections. In some examples, the unit dose chemical product concentrates may include at least one of tablets, pellets, loose powders, encapsulated gels, or encapsulated powders. In some examples, the unit dose chemical product concentrates comprise a chemical cleaning product.

In another example, the disclosure is directed to a dispensing system comprising a dispensing unit configured to dispense one or more types of chemical product concentrates, the dispensing unit including one or more shaped dispensing receptacles, each of the one or more shaped receptacles having one of a defined set of geometrically shaped inner cross-sections; and a plurality of shaped dispensing cartridges, each shaped dispensing cartridge having one of the defined set of geometrically shaped outer cross-sections, and each having a longitudinal cavity sized to receive a plurality of unit dose chemical product concentrates, wherein each one of the defined set of geometrically shaped outer cross-sections corresponds to a different type of the one or more types of chemical product concentrate, the geometrically shaped outer cross-section of each of the plurality of shaped dispensing cartridges further sized and shaped to be geometrically compatible with one of the one or more shaped dispensing receptacles. In some examples, the unit dose chemical product concentrates may include at least one of tablets, pellets, loose powders, encapsulated gels, or encapsulated powders. In some examples, the unit dose chemical product concentrates comprise a chemical cleaning product.

In another example, the disclosure is directed to a dispensing system comprising a plurality of shaped dispensing cartridges, each shaped dispensing cartridge having a longitudinal cavity sized to receive a plurality of unit dose chemical product concentrates, each shaped dispensing cartridge further including a shaped dispensing fitment having one of a defined set of geometrically shaped inner cross-sections, and wherein each one of the defined set of geometrically shaped inner cross-sections corresponds to a different type of unit dose chemical product concentrate; and a plurality of product bottles, each product bottle having a shaped neck sized and shaped to be geometrically compatible with the shaped fitment of at least one of the plurality of shaped dispensing cartridges. In some examples, the unit dose chemical product concentrates may include at least one of tablets, pellets, loose powders, encapsulated gels, or encapsulated powders. In some examples, the unit dose chemical product concentrates comprise a chemical cleaning product.

The details of one or more examples are set forth in the accompanying drawings and the description below. Other features and advantages of the disclosure will be apparent from the description and drawings, and from the claims.

DETAILED DESCRIPTION

Figure 1A:
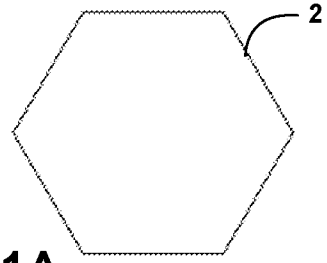
FIG. 1A-1C are diagrams illustrating various views of an example hexagonal shaped dispensing cartridge configured to store a plurality of solid chemical product concentrates.

Shaped dispensing system(s) as described herein facilitate formation and dispensation of a use solution from one or more chemical product concentrates. In some examples, the dispensing systems may include one or more differently shaped dispensing cartridges sized to fit within geometrically compatible shaped receptacles of a dispensing unit. In general, the shaped dispensing cartridges can define any polygonal (e.g., square, hexagonal, cross, star, etc.) or arcuate (e.g., circular, elliptical, etc.) shape, or any combination of polygonal and arcuate shapes (trefoil, notched, etc.), or any other regular or irregular shape. Each shaped dispensing cartridge may be designated to correspond to a different type of chemical product concentrate. For example, a shaped dispensing cartridge for detergent tablets may have a pentagonal shape, a shaped dispensing cartridge for sanitizer tablets may have a hexagonal shape, and a shaped dispensing cartridge for floor care product tablets may have a notched hexagonal shape.

In some examples, a dispensing unit may include one or more shaped product receptacles, each configured to receive a geometrically compatible shaped dispensing cartridge. The shaped product receptacle(s) are configured so that geometrically incompatible dispensing cartridges may not be received therein. In other words, the shaped receptacles are configured to reject the shaped dispensing cartridges having geometrically incompatible shaped cross-sections. This may help to ensure that cartridges containing incorrect chemical products will not be loaded into incompatible receptacles of the dispensing unit. In another example, one or more shaped dispensing cartridges may provide a hand-held shaped cartridge chemical product concentrate dispensing system. For example, a shaped dispensing cartridge may be configured to receive a geometrically compatible shaped neck of a product bottle and to dispense a unit dose of a chemical product concentrate into the product bottle. In other words, the shaped dispensing may be configured to reject product bottles having geometrically incompatible shaped bottle necks. Each shaped dispensing cartridge may be designated to correspond to a different type of chemical product concentrate. The shaped dispensing cartridges may help to prevent incorrect chemical product concentrates from being dispensed into a product bottle having a geometrically incompatible shaped bottle neck.

Many different chemical products may be dispensed as unit dose chemical product concentrate. For example, chemical cleaning products may be dispensed as unit dose tablets of solid chemical product concentrate. In other examples, the chemical product concentrate may be dispensed as a known quantity (e.g., weight or volume) of pellets or loose powders. In other examples, the chemical product concentrate may be dispensed as unit dose encapsulated or packeted pellets, powders, gels, or foams. Some example chemical cleaning products include detergents, disinfectants, sanitizers, laundry detergent, pot and pan detergent, automatic dish machine detergent, window cleaners, hard surface cleaners, bathroom cleaners, toilet cleaners, floor cleaners, car cleaners and other car care products, concrete cleaners, kitchen and sink cleaners, tile cleaners, shower cleaners, and other household types of cleaners. It shall be understood that any product may be dispensed that can be made from a concentrate and be diluted to a ready to use product, and that the disclosure is not limited in this respect.

Figure 1B:
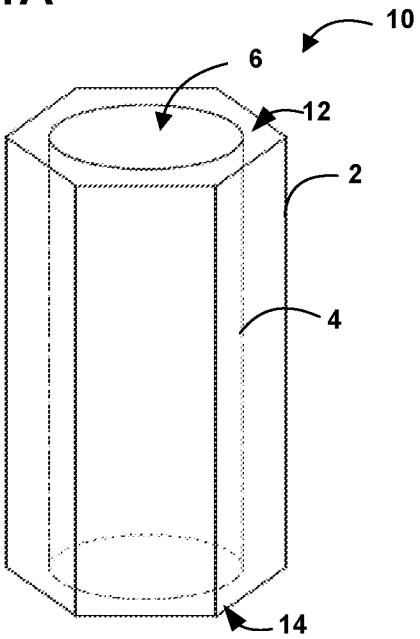

FIG. 1A-1B are diagrams illustrating a top view and a perspective view, respectively, of an example shaped dispensing cartridge 10. FIG. 1 C is a perspective view of the shaped dispensing cartridge 10 of FIG. 1A having a plurality of solid chemical product concentrates (tablets in this example) 20 stored therein.

Figure 1C:
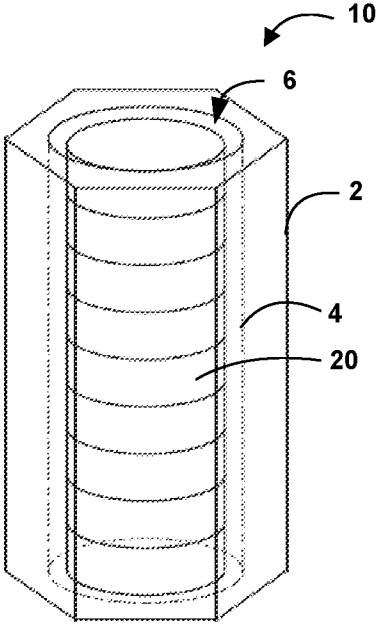

As shown in FIGS. 1A-1C, example shaped dispensing cartridge 10 includes six sidewalls 2 forming a hexagonally shaped outer cross-section as shown in the top view of FIG. 1A. A generally cylindrical cavity 6 defined by an inner sidewall 4 extends longitudinally from a first end 12 to a second end 14 of cartridge 10. In this example, the diameter of cavity 6 is sized to receive a plurality of tablets 20 in a stacked arrangement, as shown in FIG. 1C.

Although the outer cross-section of example dispensing cartridge 10 is shown as hexagonal in shape, it shall be understood that the outer cross-section of shaped dispensing cartridge 10 may be any shape, including a circle, oval, square, triangle, octagon, star, or any other polygon or geometrically closed shape. The sidewall(s) may include one or more curves or straight edges. The outer cross-section of shaped dispensing cartridge 10 may also include one or more notches, grooves, indentations, dimples, ridges, or other means of changing or modifying the cross-sectional shape.

Figure 2A:
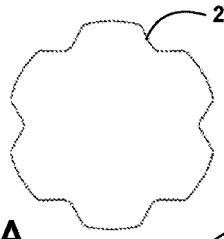
FIGS. 2A-2B are diagrams illustrating a top view and a perspective view, respectively, of an example 6-notched cylindrical dispensing cartridge configured to store a plurality of solid chemical product concentrates.
Figure 2B:
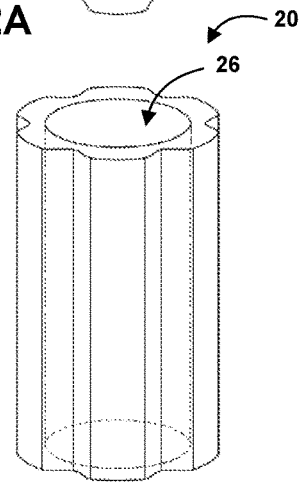
Figure 3A:
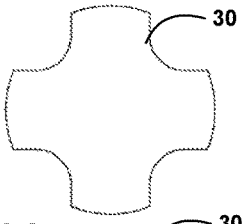
FIGS. 3A-3B are diagrams illustrating a top view and a perspective view, respectively, of an example 4-notched cylindrical dispensing cartridge configured to store a plurality of solid chemical product concentrates.
Figure 3B:
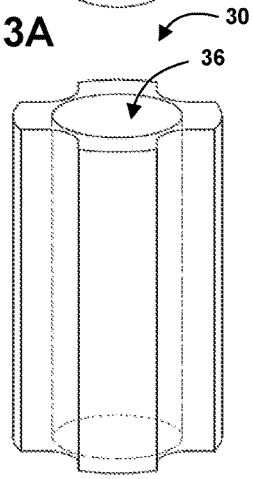
Figure 4A:
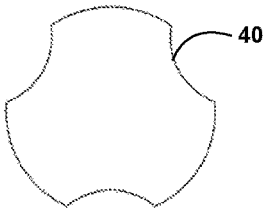
FIGS. 4A-4B are diagrams illustrating a top view and a perspective view, respectively, of an example 3-notched cylindrical dispensing cartridge configured to store a plurality of solid chemical product concentrates.
Figure 4B:
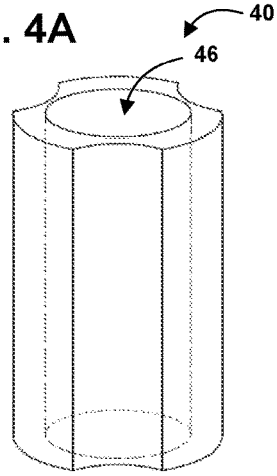
Figure 5A:
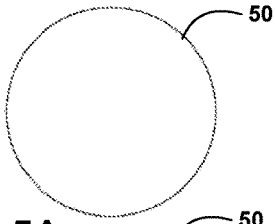
FIGS. 5A-5B are diagrams illustrating a top view and a perspective view, respectively, of a cylindrical dispensing cartridge configured to store a plurality of solid chemical product concentrates.
Figure 5B:
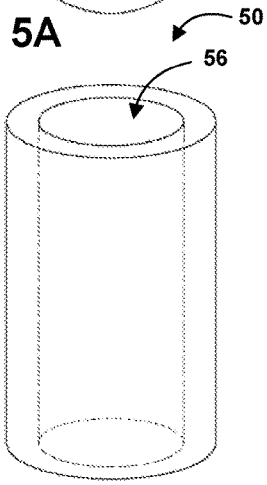
Figure 6A:
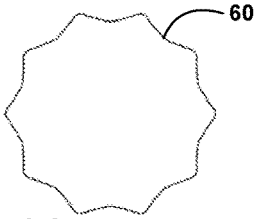
FIGS. 6A-6B are diagrams illustrating a top view and a perspective view, respectively, of an example 10-notched cylindrical dispensing cartridge configured to store a plurality of solid chemical product concentrates.
Figure 6B:
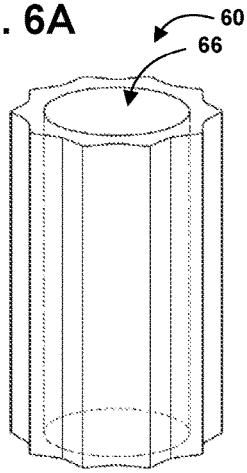

For example, FIGS. 2A-2B are diagrams illustrating an outer cross-sectional view and a perspective view, respectively, of an example 6-notched cylindrical dispensing cartridge 20 configured to store chemical product concentrates. FIGS. 3A-3B are diagrams illustrating an outer cross-sectional view and a perspective view, respectively, of an example 4-notched cylindrical dispensing cartridge 30 configured to store chemical product concentrates. FIGS. 4A-4B are diagrams illustrating an outer cross-sectional view and a perspective view, respectively, of an example 3-notched cylindrical dispensing cartridge 40 configured to store chemical product concentrates. FIGS. 5A-5B are diagrams illustrating an outer cross-sectional view and a perspective view, respectively, of a cylindrical dispensing cartridge 50 configured to store chemical product concentrates. FIGS. 6A-6B are diagrams illustrating an outer cross-sectional view and a perspective view, respectively, of an example 10-notched cylindrical dispensing cartridge 60 configured to store chemical product concentrates.

In the examples of FIGS. 2A-2B, 3A-3B, 4A-4B, 5A-5B, and 6A-6B, each of example shaped cartridges 20, 30, 40, 50 and 60 forms a cylindrical cavity 26, 36, 46, 56, and, 66, respectively, configured and sized to hold a plurality of tablets in a stacked arrangement similar to that shown with respect to FIG. 1C. However, it shall be understood that the shaped dispensing cartridges may also be configured and sized to hold a plurality of tablets in a non-stacked arrangement, or other types of chemical product concentrates, such as pellets, loose powders, or unit dose capsules or packets of a gel or a powder, and that the disclosure is not limited in this respect.

Each shaped cartridge may correspond to a different type of chemical product concentrate. For example, a hexagon shaped dispensing cartridge may correspond to disinfectant tablets, a cylindrical shaped cartridge may correspond to glass cleaner tablets, an octagon shaped cartridge may correspond to sanitizer tablets, and a 3-notched cylindrical shaped cartridge may correspond to detergent tablets. In some examples, the shaped cartridges and/or the cartridge receptacle(s) of a dispenser unit may further be color-coded to visually facilitate identification of the tablet contents and insertion of the shaped cartridges into the complementary dispenser receptacles.

A shaped cartridge, such as one or more of shaped cartridges 10, 20, 30, 40, 50 and/or 60, may be used as part of a lock and key chemical product concentrate dispensing system. For example, a dispenser may include one or more shaped receptacles within the dispensing unit housing. Each shaped receptacle may have a cross-section that is configured to receive geometrically compatible shaped dispensing cartridges. In other words, the cross-section of each shaped receptacle may be sized and shaped to compatibly receive the cross-sectional size and shape of the dispensing cartridge intended to be inserted into the receptacle. The product receptacle and the dispensing cartridge may be said to be "compatible" if the dispensing cartridge fits within the product receptacle such that the shaped dispensing cartridge may be properly loaded into the dispensing unit for dispensation of the chemical product concentrate.

In some examples, the cross-section of the dispensing cartridge and the product receptacle have the same geometric shape. For example, for a dispensing cartridge having a hexagonally shaped cross-section, a corresponding compatible product receptacle may have a compatible hexagonally shaped cross-section. The cross-section of the shaped receptacle may have inner measurements that are slightly larger than the measurements of the cross-section of the dispensing cartridge, such that the dispensing cartridge closely fits within the shaped receptacle of the dispensing unit. This geometric shaped design may also help to ensure that only the correct dispensing cartridge may be loaded into a particular receptacle, thus further helping to ensure that the correct chemical product concentrate is dispensed.

In other examples, the cross-section of the shaped receptacle and the dispensing cartridge are compatible in the sense that the dispensing cartridge fits within the shaped receptacle, but the cross-sections are not necessarily the same shape. For example, a hexagonally shaped receptacle may receive a square shaped dispensing cartridge, a triangular shaped dispensing cartridge, etc. Thus, although most of the examples described herein describe product receptacles and shaped dispensing cartridges having the same cross-sectional shape, it shall be understood that the disclosure is not limited in this respect, and that a one-to-one correspondence between the cross-sectional shape of the product receptacle(s) and the shaped dispensing cartridge(s) is not required to achieve the lock and key function described herein.

Figure 7:
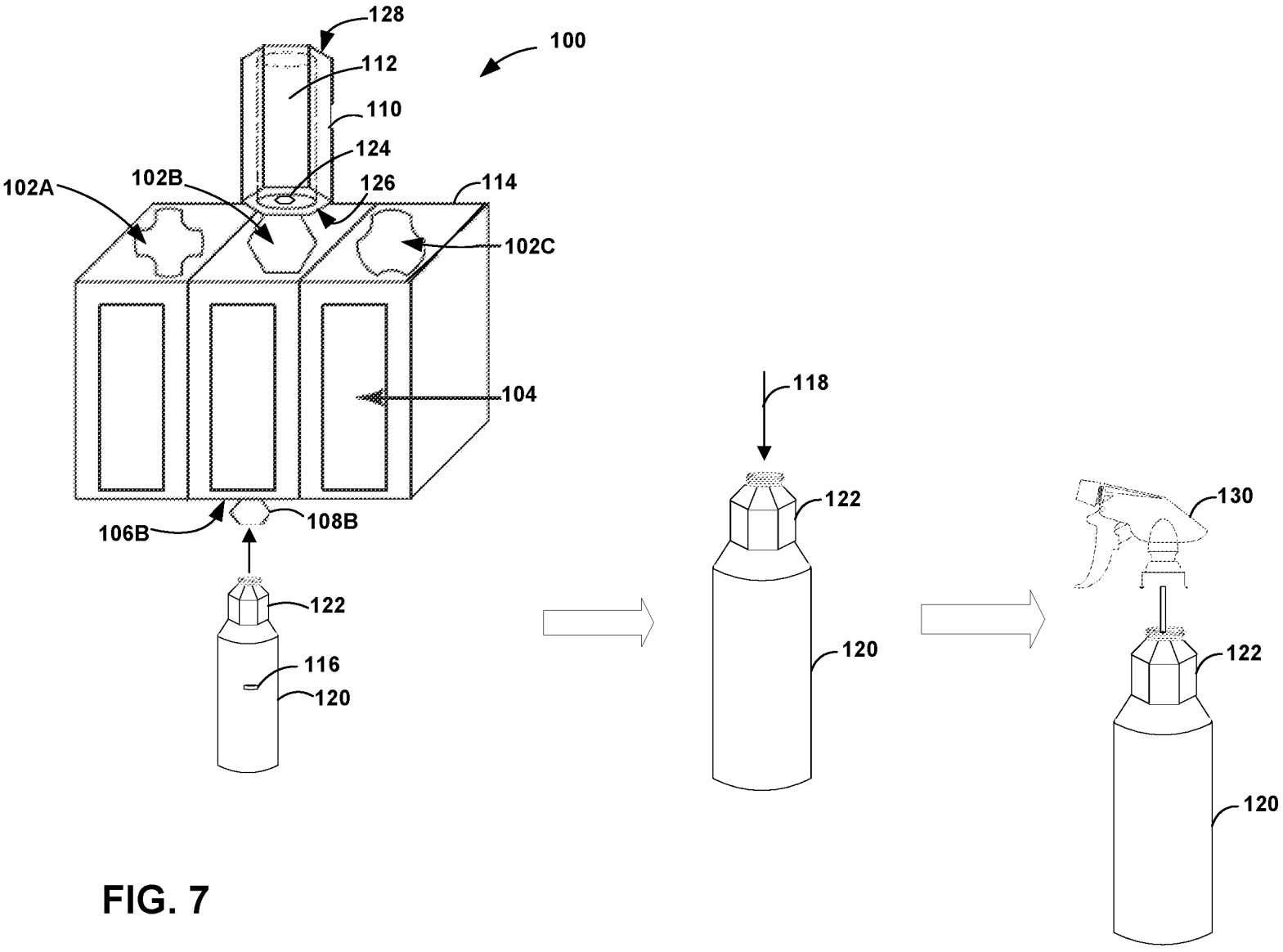
FIG. 7 is a diagram of a multiple product dispensing system including a dispenser configured to received multiple shaped dispensing cartridges and to dispense unit dose tablets into bottles having like-shaped bottle necks.

FIG. 7 is a diagram of an example multiple product dispensing system 100. The goal is to provide a chemical product concentrate delivery system that can house multiple chemical product concentrate formulas using a shaped product cartridge. Dispensing system 100 includes a dispensing unit 114 configured to receive one or more differently shaped dispensing cartridges, such as hexagonally shaped dispensing cartridge 110. Dispensing system may be further configured to dispense unit dose tablets into bottles, such as bottle 120, having like-shaped bottle necks. Dispensing unit 114 includes one or more shaped receptacles 102A, 102B, and 102C, each sized and shaped to receive a geometrically compatible shaped dispensing cartridge. For example, receptacle 102B has a hexagonal cross-section sized and shaped to receive only a compatibly sized and shaped dispensing cartridge, such as cartridge 110. Cartridge 110 includes a longitudinal cavity sized to receive the chemical product concentrate 112 (tablets in this example) to be dispensed. In this example, cartridge 110 includes a first end 12 and a second end 128, and further includes a correspondingly shaped cut-out 124 on first end 126 of the cartridge from which tablets (or other chemical product concentrate) may be dispensed. First end 126 of cartridge 110 is inserted downwardly into the geometrically compatible hexagon shaped receptacle 102B in dispensing unit 114. The shaped dispensing cartridges help to prevent the incorrect chemical product concentrates from being inserted into a non-compatible receptacle in the dispensing unit 114. Dispensing unit 114 may further include a sight glass 104 into one or more of the receptacles so that a user may view if cartridge is low and/or empty.

Each receptacle on the dispensing unit may further include a shaped fitment sized to receive a correspondingly sized fitting on the neck of a product bottle. For example, a hexagonally shaped fitment 108B at a base 106B of dispensing unit 114 located under the hexagonally shaped receptacle 102B is sized to receive a hexagonally shaped neck 122 of a bottle 120. A plurality of shaped bottle necks may correspond to, for example, one or more of the shapes shown in FIG. 1-6, or other shapes. In this example, a bottle 120 having a hexagonally shaped bottle neck 108B is inserted into its geometrically compatible shaped fitment 106B in the dispenser unit 114. A metering device (not shown in FIG. 7) within the dispensing unit 114 dispenses a single unit dose tablet 116 into the bottle from the shaped cartridge 110. Water may be added to bottle 120 as indicated by arrow 118 up to a designated fill level. This ensures that the correct dilution (concentration) of the chemical product is achieved once the tablet dissolves. A spray nozzle 130, cap or other desired fitment may be attached to bottle 120, which is now filled with the correct chemical product dilution.

Figure 8:
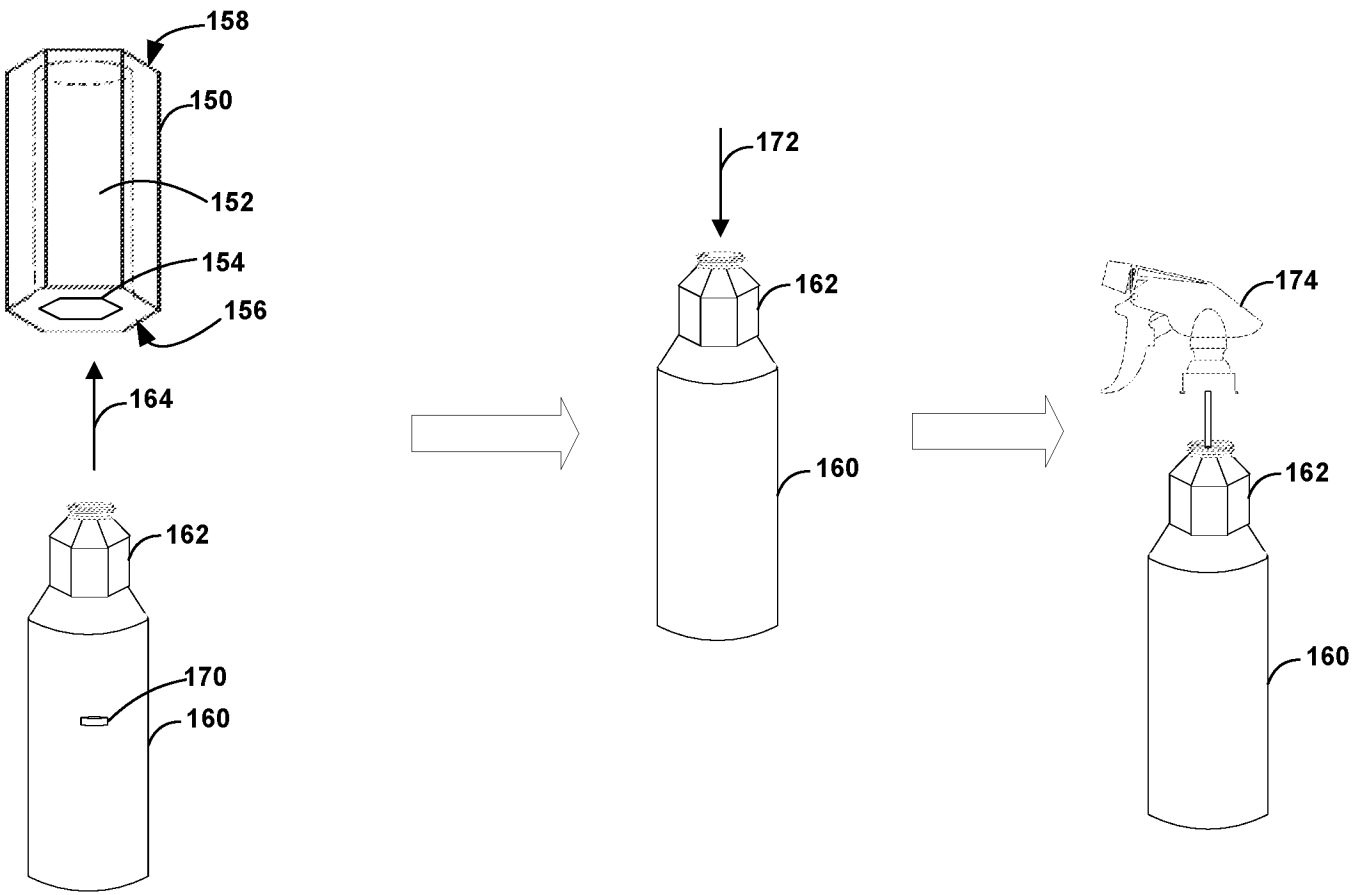
FIG. 8 is a diagram of a shaped dispenser cartridge configured to receive like-shaped neck of a product bottle and dispense unit dose tablets into the product bottle.

FIG. 8 is a diagram of an example shaped dispenser cartridge 150 configured to receive a geometrically compatible shaped neck 162 of a product bottle 160 and dispense unit dose tablets into the product bottle 160. The shaped dispenser cartridge 150 thus provides a hand-held shaped cartridge chemical product concentrate delivery system. Shaped dispensing cartridge 150, in this example having a hexagonal cross-section, includes a longitudinal cavity sized to receive a plurality of chemical product concentrates 152.

Cartridge 150 further includes a like-shaped fitment 154 on a first end 156 of the cartridge. Fitment 154 is sized to receive a geometrically compatible fitting on a neck 162 of product bottle 160. A plurality of shaped bottle necks and cartridge fitments may correspond to, for example, one or more of the shapes shown in FIG. 1-6, or other shapes. In this example, a bottle 160 having a hexagonally shaped bottle neck 162 is inserted into its geometrically compatible shaped fitment 154 in shaped dispensing cartridge 150. The shaped fitments of the shaped dispensing cartridges help to prevent the incorrect chemical product concentrates from being inserted into a non-compatible neck 162 of a product bottle 160. A metering device (not shown in FIG. 8) within the shaped dispensing cartridge dispenses a single unit dose tablet 170 into bottle 160 from the shaped cartridge 150. Water may be manually added to bottle 160 as indicated by arrow 172 up to a designated fill level. This ensures that the correct dilution (concentration) of the chemical product is achieved once the tablet 170 dissolves. A spray nozzle 174, cap or other desired fitment may be attached to bottle 160, which is now filled with the correct chemical product dilution.

Figure 9A:
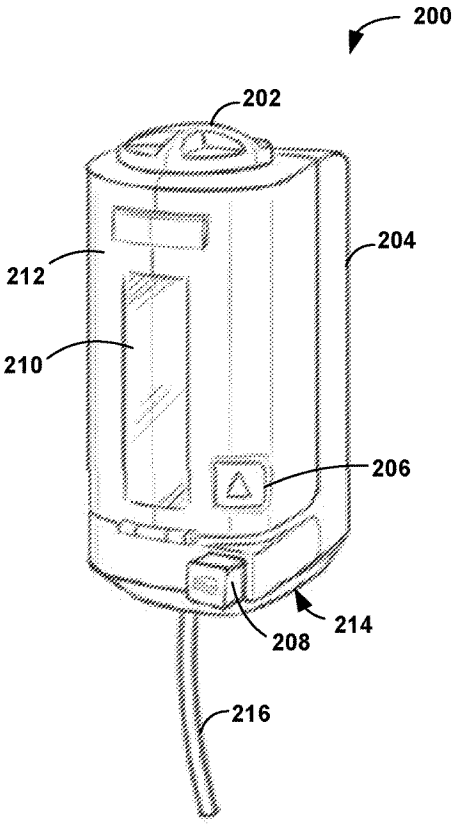
FIGS. 9A-9C are diagrams illustrating another example dispenser that can house and dispense multiple chemical product formulas in the form of differently shaped unit dose tablets.
Figure 9B:
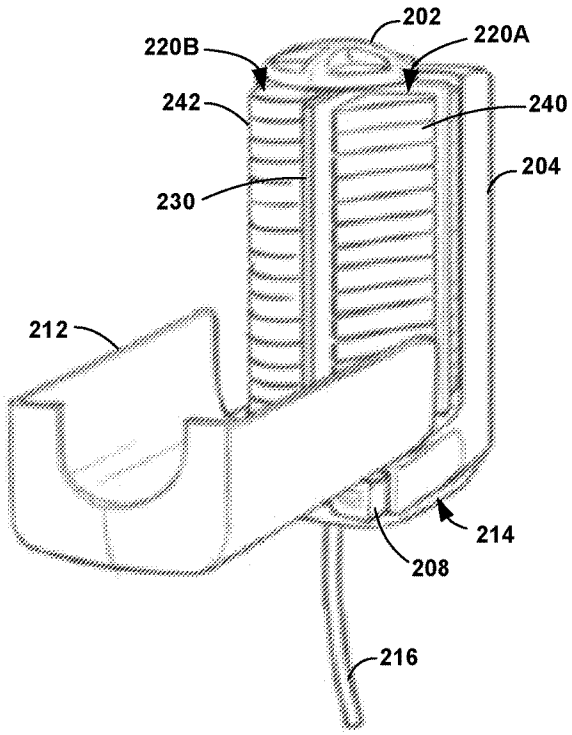
Figure 9C:
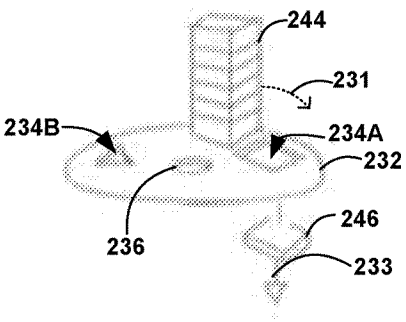

FIGS. 9A-9C are diagrams illustrating another example dispenser 200 that can house and dispense multiple chemical product formulas in the form of differently shaped unit dose tablets. Dispenser 200 includes a housing 204, a product selection knob 202, a hinged front cover 212, a sight window 210, a tablet dispense button 208, and a product indicator window 206. Dispenser 200 further includes a rotatable carousel 230 having multiple longitudinal receiving areas (generally referred to as receiving areas 220), such as receiving areas 220A and 220B, and a product selection disk 232 having multiple product selection apertures, such as apertures 234A and 234B.

The dosage is pre-determined by the tablet size of the developed chemistry for each chemical product. Unit dose tablets, such as tablets 240 and 242, are loaded from the front in this example, once the door 212 is opened downward. Dispenser may be attached to a vertical pole or be wall-mounted based on the preference of the user.

The receiving areas 220 are rotationally arrayed around a central axis 236. Each shaped receiving area is sized and shaped to receive a stack of geometrically compatible shaped unit dose tablets. In this example, receiving area 220A is triangular in shape to receive compatibly shaped triangular unit dose tablets 240. Likewise, receiving area 220B is circular in shape to receive compatibly shaped circular unit dose tablets 242.

Example dispenser 200 shows a 4-product configuration with 4 receiving areas 220, although the dispenser may be configured to house any desired number of products. Different chemical products may be formed as differently shaped unit dose tablets; for example, a detergent product may be formed as triangular shaped tablets, a floor care product may be formed as square shaped tablets, a sanitizer may be formed as hexagonal shaped tablets, etc. Sight window 210 may permit a user to view the quantity of product tablets remaining in the dispenser.

Product selection knob 202 at the top of dispenser housing 204 allows a user to manually rotate carousel 230 around central axis 236 as indicated by arrow 231 to find and dispense a selected product tablet. Rotation of the carousel may also be automated or accomplished by some other mechanism. The carousel rotates over product selection disk 232 having a plurality of shaped dispensing apertures, such as apertures 234A and 234B. The product that is currently in the dispense position within the housing appears in the product indicator window 206. When the desired product is in the dispense position, the user may actuate the dispense button 208 and the selected unit dose tablet, such as tablet 246, is dispensed as indicated by arrow 233.

Dispenser 200 includes a shaped fitment positioned at a base 214 of dispenser 200 below carousel 232. The fitment may be sized and shaped to receive a geometrically compatible shaped fitting on a neck of product bottle, as described above with respect to FIGS. 7 and/or 8. The shaped fitment may help to prevent the incorrect chemical product concentrates from being dispensed into a non-compatible neck of a product bottle 160.

In some examples, dispenser 200 may be plumbed, such that the tablet is dispensed into a mixing basin or reservoir at the base of the dispenser 200 and automatically mixed with a predetermined quantity of water or other diluent, after which a resultant use solution is dispensed via line 216 into, for example, a bottle having a geometrically compatible shaped bottle neck as described above with respect to FIGS. 7 and/or 8. In other examples, dispenser 200 is non-plumbed, such that the tablet is dispensed directly into a product bottle or other transport mechanism, such as a bucket or pail, as described above with respect to FIGS. 7 and/or 8.

Figure 10B:
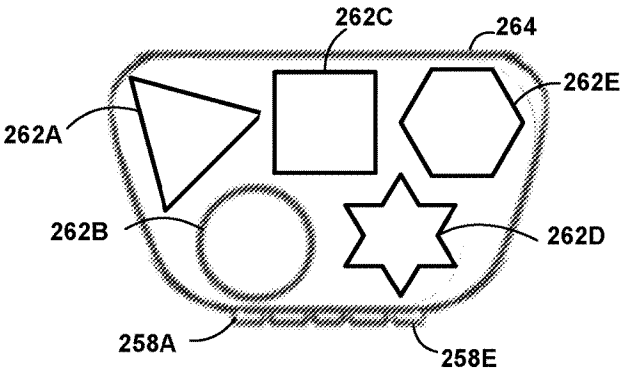
FIGS. 10A-10C are diagrams illustrating another example dispenser that can house and dispense multiple chemical product formulas from differently shaped dispensing cartridges.
Figure 10C:
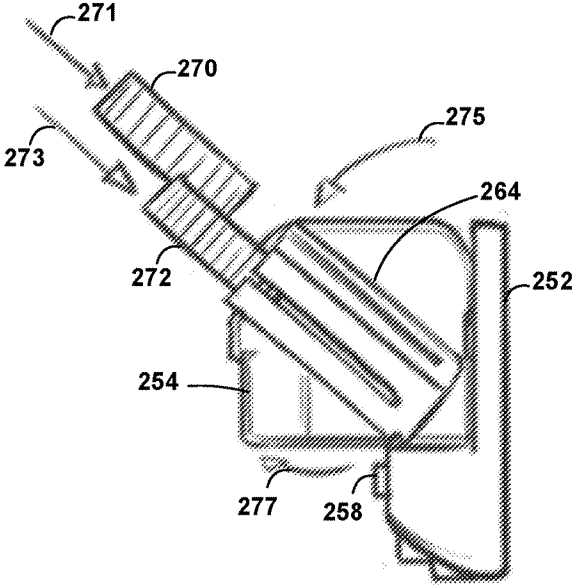
Figure 10A:
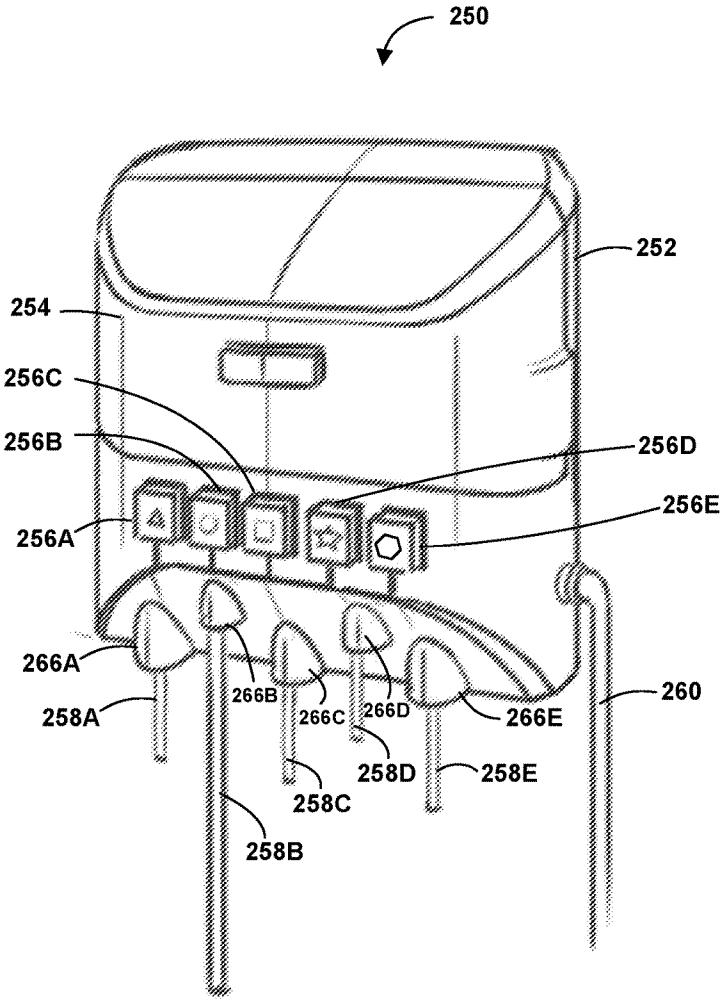

FIGS. 10A-10C are diagrams illustrating another example dispenser 250 that can house and dispense multiple chemical product concentrates (tablets in this example) from differently shaped dispensing cartridges. Dispenser 250 includes a housing 252, a hinged front cover 254, dispense buttons 256A-256E, dispensing ports 266A-266E, and dispensing lines 258A-258E. In this example, dispenser 250 is plumbed via input line 260 to receive water for dissolving dispensed unit dose tablets (or other unit dose form factor) in a reservoir (not shown) internal to the dispenser to create a use solution having the appropriate dilution/concentration of the chemical product. Dispenser 250 further includes a carousel 264 having multiple longitudinal shaped receiving areas 262A-262E, each sized to receive a respective geometrically compatible shaped dispensing cartridge. Although in this example dispenser 250 is shown to include five shaped receiving areas, it shall be understood that dispenser 250 may be configured to include one or more shaped receiving areas, and that the disclosure is not limited in this respect.

The dosage is pre-determined by the tablet size of the developed chemistry for each chemical product. In this example, shaped dispensing cartridges, such as cartridges 270 and 272, may be loaded from the top when door 254 is opened outwardly in direction of arrow 277 and carousel 264 is rotated downwardly in direction of arrow 275 as shown in FIG. 10C. Dispenser 250 may be attached to a vertical pole or be wall-mounted based on the preference of the user.

Carousel 264 of dispenser 250 includes one or more shaped receiving areas 262A-262E, each sized and shaped to receive a geometrically compatible shaped dispensing cartridge. For example, receiving area 262A may have a triangular cross-section sized and shaped to receive only a geometrically compatible sized and shaped dispensing cartridge, such as shown and described above with respect to FIGS. 7 and/or 8. To dispense the desired use solution, a user actuates the desired tablet dispense button 256A-256E. A metering unit within dispenser 250 causes one unit dose tablet of the selected chemical product to be dispensed into an interior reservoir of dispenser 250, where it is mixed with an appropriate volume of incoming water to dissolve the tablet and form a use solution having the proper dilution/concentration.

Each dispensing port 266A-266E may further includes a shaped fitment sized to receive a geometrically compatible shaped fitting on the neck of a product bottle, such as shown and described above with respect to FIGS. 7 and/or 8. The use solution formed by dissolving of a unit dose tablet in an appropriate volume of water may then be dispensed into a bottle fitted into the shaped fitment at the base of the dispensing port.

Figure 11B:
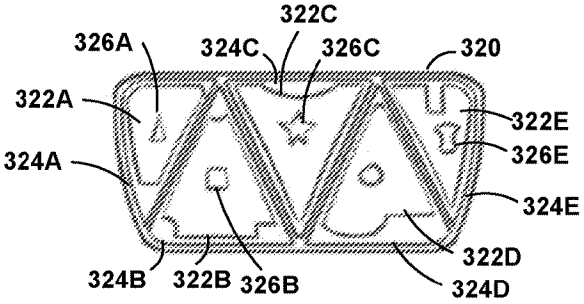
FIGS. 11A-11D are diagrams illustrating another example dispenser that may house and dispense one or more chemical product formulas from one or more differently shaped dispensing cartridges.
Figure 11D:
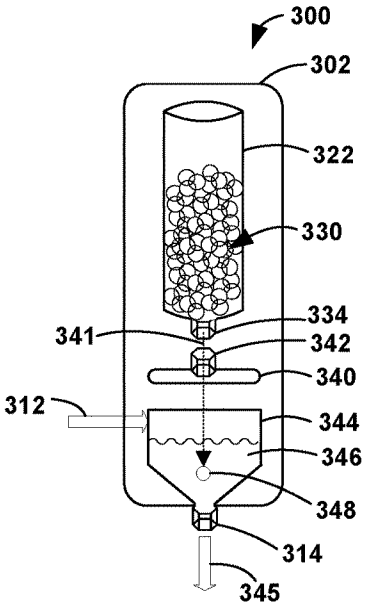

FIGS. 11A-11D are diagrams illustrating another example dispenser 300 that may house and dispense one or more chemical product formulas (tablets or pellets in this example) from one or more differently shaped dispensing cartridges. Dispenser unit 300 includes a housing 302, a cover 304, product indicators 306A-306E, dispense knobs 308A-308E, dispensing ports 314A-314E, and dispensing lines 310A-310E. In this example, dispenser 300 is plumbed via input line 312 to receive water for dissolving or eroding a dispensed unit dose tablet(s) (e.g., tablet 348 in FIG. 11D) in a reservoir 344A-344E, respectively, internal to dispenser 300 to create a use solution 346A-346E having the appropriate dilution/concentration of the chemical product (a representative reservoir 344 and use solution 346 are shown in FIG. 11D). Dispenser 300 further includes a carousel 320 having differently shaped longitudinal receiving areas 322A-322E. Dispenser 300 may further include one or more corresponding shaped fitments sized and shaped to receive a geometrically compatible fitment at the base of a dispensing cartridge. Although in this example dispenser 300 is shown to include five shaped receiving areas 324A-324E, it shall be understood that dispenser 300 may be configured to include one or more shaped receiving areas.

Figure 11C:
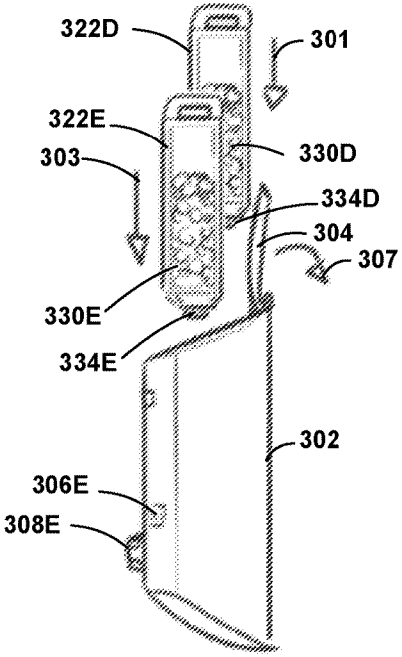
Figure 11A:
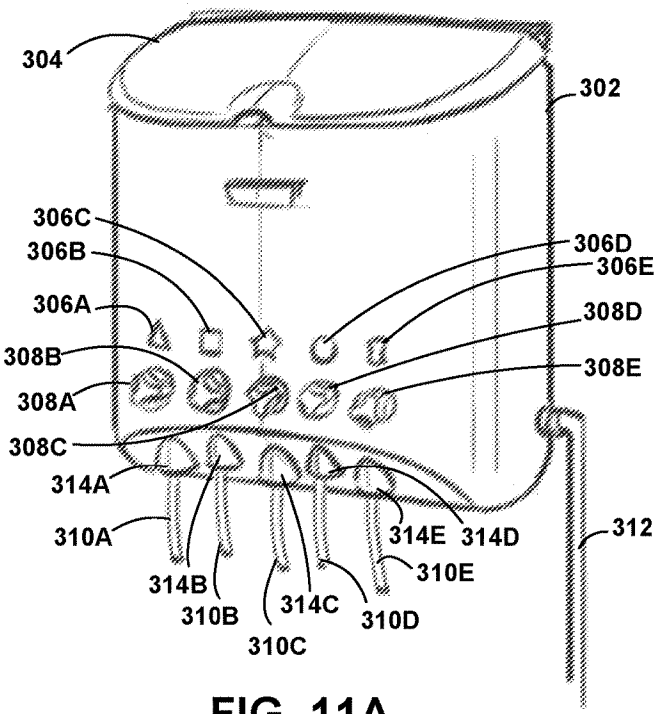

The dosage is pre-determined by the tablet size of the developed chemistry for each chemical product. Dispensing cartridges, such as cartridges 322D and 322E, may be loaded from the top when door 304 is opened upwardly in direction of arrow 307 as shown in FIG. 11C. Dispenser 300 may be attached to a vertical pole or be wall-mounted based on the preference of the user.

The interior of dispenser housing 302 includes one or more shaped receiving areas 324A-324E, each sized and shaped to receive a correspondingly shaped dispensing cartridge 322A-322E. In this example, the shaped receiving areas 324A-324E have interior cross-sections that are configured to receive geometrically compatible shaped dispensing cartridges 322A-322E, each having a different irregularly shaped cross-section. Although dispenser 300 is shown as being configured to receive five dispensing cartridges, it shall be understood that dispenser 300 may be configured to receive one or more shaped dispensing cartridges, and that the disclosure is not limited in this respect. Each shaped dispensing cartridge includes a corresponding product indicia 328A-328E, each of which corresponds to one the product indicia 306A-306E on the front of dispensing unit 300. These likewise correspond to the respective shaped dispensing port 314A-314E that receives a geometrically compatible shaped neck of a product bottle or other reservoir (such as described above with respect to FIGS. 7 and 8, for example).

In this example, each shaped dispensing cartridge 322A-322E is a hopper-style product container configured to store a plurality of unit dose product tablets 330A-330E, respectively. Each batch of unit dose tablets 330A-330E may correspond to a different chemical product. For example, unit dose product tablets 330A may correspond to a detergent, tablets 330B may correspond to a sanitizer, tablets 330C may correspond to a disinfectant, etc.

Each receiving area 324A-324E includes a shaped receiving fitment 342 configured to receive a geometrically compatible shaped fitment 334 at the base of a geometrically shaped dispensing cartridge 302. The fitments 342/334 prevent installation of an incorrect chemical product in a non-compatible receiving area of the dispenser 300.

Dispenser 300 is configured to dispense a single unit dose tablet into reservoir 344. To that end, each receiving area 324A-324E includes a metering device 340 (FIG. 11D) configured to dispense a single unit dose tablet 330 (or other form factor) into the corresponding reservoir 344. To dispense the desired use solution, a user actuates (rotates in this example) the desired dispense knob 308A-308E. A corresponding metering device 340A-340E within dispenser 300 causes one unit dose tablet of the selected chemical product concentrate to be dispensed into an interior reservoir 344A-344D of dispenser 300, where it is mixed with an appropriate volume of incoming water to dissolve the tablet and form a use solution 346A-346E having the proper dilution/concentration.

Each dispensing port 314A-314E may further includes a shaped fitment sized to receive a geometrically compatible fitting on the neck of a product bottle, such as shown and described above with respect to FIGS. 7 and/or 8. The use solution formed by dissolving of a unit dose tablet in an appropriate volume of water may then be dispensed into a bottle fitted into the shaped fitment at the base of the dispensing port as indicated by arrow 345 of FIG. 11D.

Figure 12B:
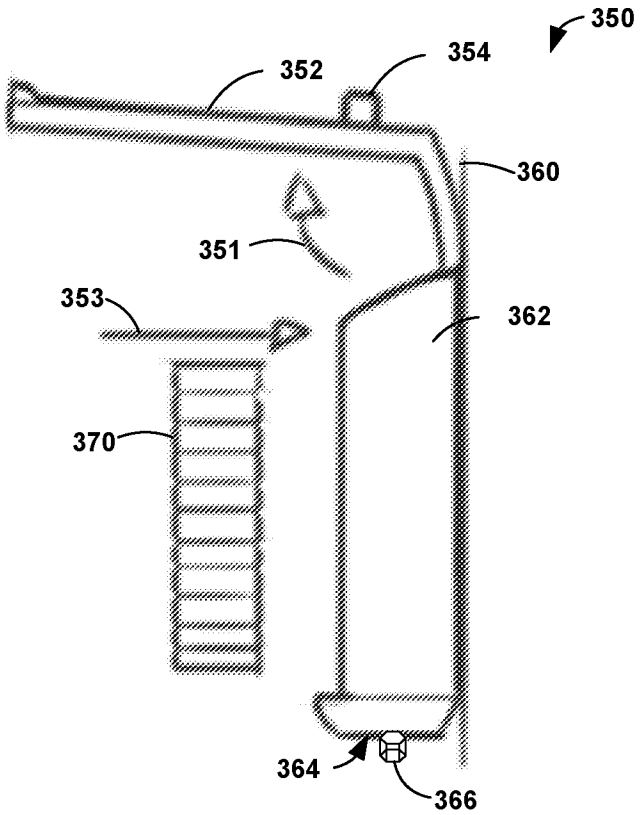
FIGS. 12A-12B are diagrams illustrating another example dispenser that may house and dispense one or more chemical product formulas from one or more differently shaped dispensing cartridges.
Figure 12A:
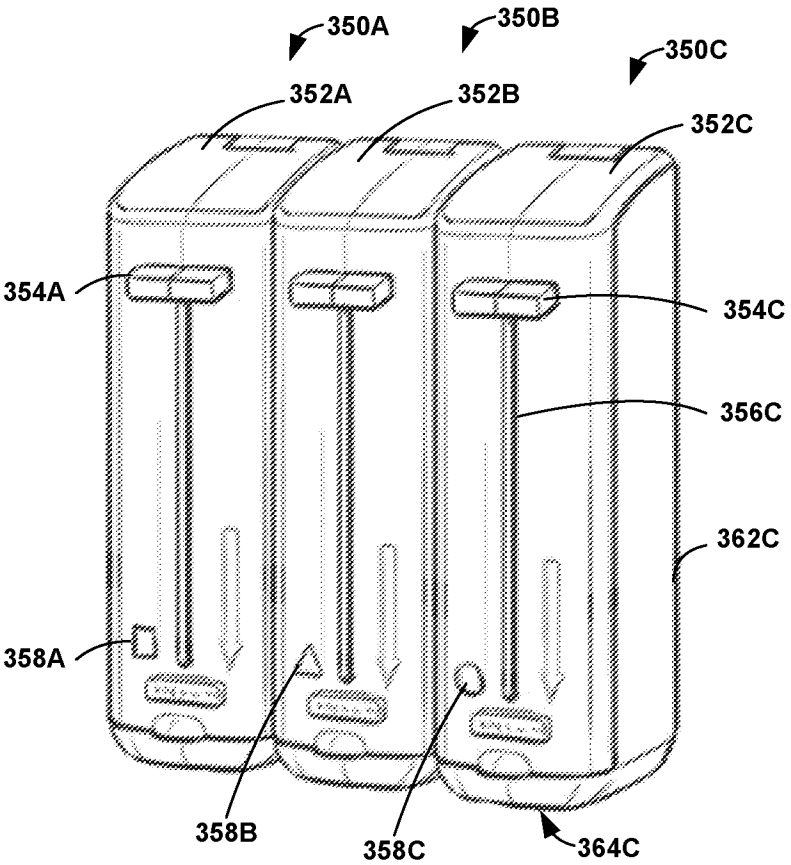

FIGS. 12A-12B are diagrams illustrating another example dispenser 350 that may house and dispense one or more chemical product formulas. Example dispenser 350 is a manual dispenser system including one or more unit dose dispensing units 352A-352C. Each dispensing unit includes a housing 362A-362C, a door 352A-352C, a product indicator 358A-358C, and a manual slide lever 354A-354C that moves within a slot 356A-356C.

In this example, the dispersion 350 is not plumbed and the unit dose tablets are dispensed without mixing. There is one unit per product and the dispensing units 352A-352C may be installed or mounted side by side, as shown in FIG. 12A. However, although three dispensing units 352A-352C are shown in FIG. 12A, it shall be understood that one or more units may be installed, and that the disclosure is not limited in this respect. One or more dispensing units may be installed consecutively on a wall or other mounting surface 360. Unit dose tablets are advanced and dispensed from each dispensing unit 352A-352C manually via slide levers 354A-354C, respectively. A preset range on each dispensing unit 352A-352B may determine quantity of tablets dispensed and thus the dosage. In this example, unit dose tablet stacks, such as tablet stack 370 as shown in FIG. 12B, may be loaded from the front of a dispensing unit 352 as indicated by arrow 353 after door 352 is moved up into the open position as indicated by arrow 351. A fitment 366 at the base 364 of each dispensing unit 352 is sized and shaped to receive a geometrically compatible shaped neck of a product bottle or other transport mechanism, allowing only the correct product to be ejected into the bottle/transport mechanism.

FIGS. 13A-13D are diagrams illustrating another example dispenser that may house and dispense one or more chemical product formulas. Example dispenser is a manual dispenser system including one or more unit dose dispensing units 400A-400C. Each dispensing unit 400A-400C includes a housing 402A-402C, a door 406A-406C, a product indicator 404A-404C, and a rotary dispensing knob 408A-408C, respectively.

In this example, the chemical product concentrate may be dispensed with or without mixing. If the dispenser(s) 400A-400C are to be configured for dispensing a use solution, water or other diluent may be received via input line 412 for eroding/dissolving a unit dose tablet within a reservoir internal to the dispensing unit 400A-400C, similar to that shown and described with respect to FIGS. 11A-11D.

Figure 13C:
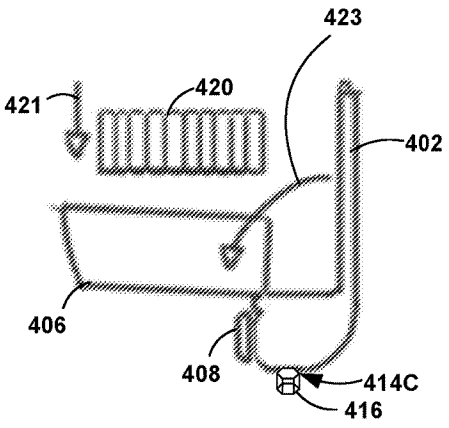
FIGS. 13A-13D are diagrams illustrating another example dispenser that may house and dispense one or more chemical product formulas from one or more differently shaped dispensing cartridges.
Figure 13D:
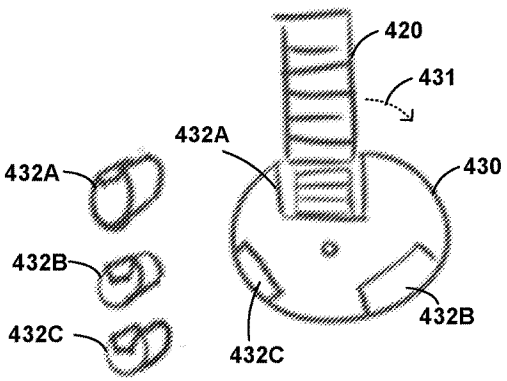
Figure 13B:
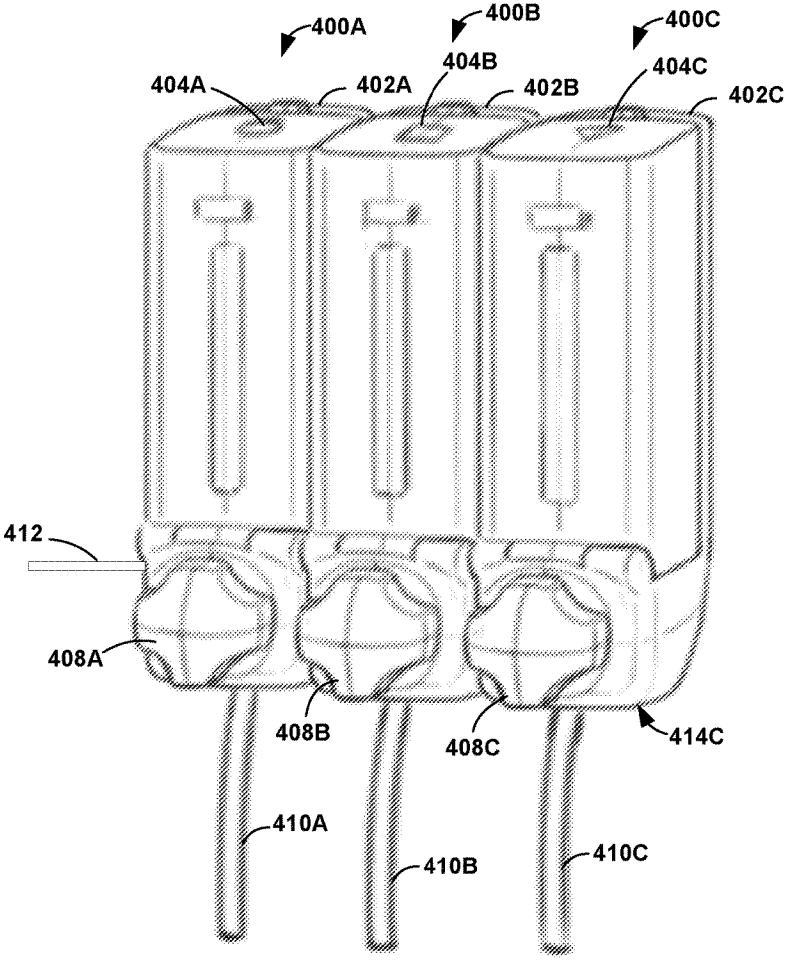
Figure 13A:
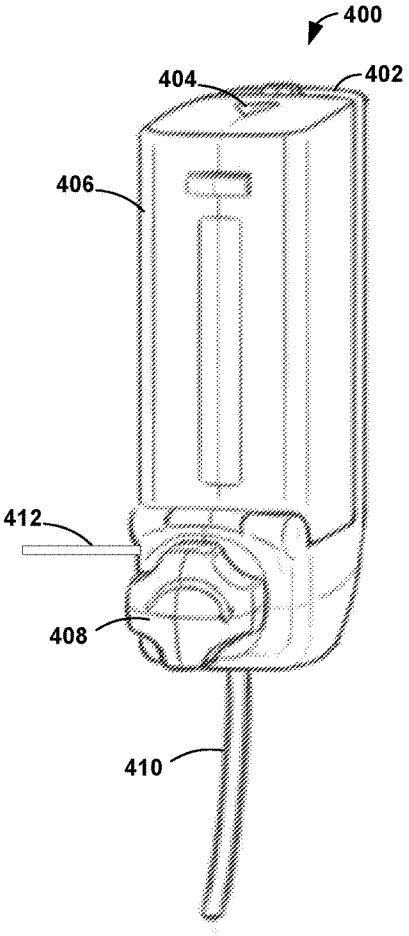

There is one unit per product and one or more dispensing units 400A-400C may be installed or mounted side by side, as shown in FIG. 13B. Although three dispensing units 400A-400C are shown in FIG. 13B, it shall be understood that one or more units may be installed, and that the disclosure is not limited in this respect.

Shaped dispensing cartridges, such as cartridge 420 as shown in FIG. 13C, may be loaded from the front of a dispensing unit 400 as indicated by arrow 421 after door 406 is moved downwardly into the open position as indicated by arrow 423. A selected dose (e.g., volume) of chemical product concentrate, such as tablets, pellets, or powders, may be dispensed from each dispensing unit 400A-400C manually via rotatable knobs 408A-408C, respectively. A rotary wheel 430 internal to the dispenser includes one or more wheel pockets, such as wheel pockets 432A-432C, the depth and/or volume of which determines the amount of chemical product (or dosage) dispensed.

A shaped fitment 416 at the base 414 of each dispensing unit 400 is sized and shaped to receive a geometrically compatible shaped neck of a product bottle or other transport mechanism, allowing only the correct product to be ejected into the bottle/transport mechanism.

Various examples have been described. These and other examples are within the scope of the following claims.

The invention claimed is:

1. A dispensing system comprising:

a plurality of shaped dispensing cartridges, each shaped dispensing cartridge having one or more outer sidewalls forming one of a plurality of geometrically shaped outer cross-sections extending from a first end to a second end, wherein each of the plurality of geometrically shaped outer cross-sections corresponds to a different one of a plurality of chemical product concentrate types, each shaped dispensing cartridge further having a generally cylindrical cavity extending longitudinally from the first end to the second end, the cavity sized to receive a plurality of unit doses of the corresponding type of chemical product concentrate, the cavity forming an outlet at the first end through which one or more of the unit doses may be dispensed from the cavity; and a dispensing unit including a plurality of shaped receptacles, each shaped receptacle having a geometrically shaped interior cross-section sized to fully receive a geometrically compatible shaped dispensing cartridge, and to reject geometrically incompatible shaped dispensing cartridges, the housing further including a plurality of shaped dispensing fitments each corresponding to a different one of the plurality of geometrically shaped outer cross-sections and each positioned to align with the outlet of the geometrically compatible shaped dispensing cartridge when the first end of the geometrically compatible shaped dispensing cartridge is inserted downwardly into the corresponding shaped receptacle, each shaped dispensing fitment having a shaped cross-section configured to receive a geometrically compatible neck of a product container for dispensation of one or more of the unit doses of the chemical product from the outlet of the shaped dispensing cartridge and into the product container.

2. The system of claim 1 wherein the unit dose chemical product concentrates include at least one of tablets, pellets, loose powders, encapsulated gels, or encapsulated powders.

3. The system of claim 2 wherein the longitudinal cavity of each shaped dispensing cartridge is sized to receive a plurality of unit dose chemical product concentrates in a stacked arrangement.

4. The system of claim 1 wherein a first one of the plurality of geometrically shaped cross-sections corresponds to detergent tablets, wherein a second one of the plurality of geometrically shaped cross-sections corresponds to sanitizer tablets, and wherein a third one of the plurality of geometrically shaped cross-sections corresponds to disinfectant tablets.

5. The system of claim 1 wherein a first one of the plurality of geometrically shaped cross-sections is a hexagonally shaped cross-section, wherein a second one of the plurality of geometrically shaped cross-sections is a cylindrically-shaped cross-section, and wherein a third one of the plurality of geometrically shaped cross-sections is a 4-notched cylindrically shaped cross-section.

6. The system of claim 1 wherein the unit dose chemical product concentrates comprise a chemical cleaning product.

7. The system of claim 1 wherein the unit dose chemical product concentrates comprise at least one of a detergent, a disinfectant, or a sanitizer.

8. The system of claim 1 further comprising a plurality of dispense mechanisms, each dispense mechanism corresponding to a different one of the plurality of shaped receptacles and that when actuated causes one of the plurality of unit dose chemical product concentrates to be dispensed from one of the plurality of shaped dispensing cartridges received within the corresponding one of the plurality of shaped receptacles.

9. The system of claim 1 further comprising:

a reservoir positioned within the housing;

a dispense mechanism that when actuated causes one of the plurality of unit dose chemical product concentrates to be dispensed from a corresponding one of the shaped dispensing cartridges into the reservoir; and a valve, wherein the valve is configured, in response to actuation of the dispense mechanism, to allow one-way flow of a diluent into the reservoir to at least partially dissolve the dispensed one of the plurality of unit dose chemical product concentrates and form a use solution in the reservoir.

10. The system of claim 9 wherein the diluent comprises one of water or electrolyzed water.

11. The system of claim 9 wherein the use solution comprises a cleaning solution comprised of water and the dissolved unit dose chemical product concentrate.

12. A dispensing system in which each of a plurality of geometric shapes corresponds to a different one of a plurality of product types, comprising:

a dispensing unit configured to dispense the plurality of product types, the dispensing unit including a plurality of dispensing receptacles, each of the dispensing receptacles having an inner cross-section corresponding to a different one of the plurality of geometric shapes and sized to fully receive a geometrically compatible shaped dispensing cartridge and to reject geometrically incompatible shaped dispensing cartridges; and a plurality of shaped dispensing cartridges, each shaped dispensing cartridge having one or more sidewalls forming an outer cross-section corresponding to one of the plurality of geometric shapes extending from a first end to a second end, and each having a longitudinal cavity extending from the first end to the second end containing unit doses of the product type corresponding to the one of the plurality of geometric shapes formed by the sidewalls, the cavity forming an outlet at the first end through which one or more of the unit doses may be dispensed from the cavity.

13. The system of claim 12 wherein the one or more types of chemical product concentrates include at least one of tablets, pellets, loose powders, encapsulated gels, or encapsulated powders.

14. The system of claim 12 wherein the one or more types of chemical product concentrates include chemical product concentrates having a unit dose form factor.

15. The system of claim 12 wherein the one or more types of chemical product concentrates comprise at least one chemical cleaning product.

16. The system of claim 12 wherein the one or more types of chemical product concentrates comprise at least one of a detergent, a disinfectant, or a sanitizer.

17. A dispensing system in which each of a plurality of geometric shapes corresponds to a different one of a plurality of product types comprising:

a plurality of shaped dispensing cartridges, each shaped dispensing cartridge including one or more outer sidewalls forming one of a plurality of geometrically shaped cross-sections corresponding to one of the plurality of geometric shapes extending from a first end to a second end of the dispensing cartridge and having a longitudinal cavity extending from the first end to the second end sized to receive a plurality of unit doses of the corresponding type of chemical product concentrates, the cavity forming an outlet at the first end through which one or more of the unit doses may be dispensed from the cavity, each shaped dispensing cartridge further including a shaped dispensing fitment at the outlet having a shaped inner cross-sections-corresponding to the one of the plurality of geometric shapes; and a plurality of product bottles, each product bottle having a neck sized and shaped to be geometrically compatible with the shaped fitment of at least one of the plurality of shaped dispensing cartridges.

18. The dispensing system of claim 17 wherein the chemical product concentrates comprise at least one chemical cleaning product.

19. The dispensing system of claim 17 wherein the chemical product concentrates comprise at least one of a detergent, a disinfectant, or a sanitizer.

* * * * *